US005083107A

United States Patent [19]

Takahashi et al.

[11] Patent Number: 5,083,107

[45] Date of Patent: Jan. 21, 1992

[54] FIRE ALARM SYSTEM

[75] Inventors: Kaoru Takahashi; Akio Tsumuji; Ryuji Shutoku, all of Tokyo, Japan

[73] Assignee: Nohmi Bosai Kabushiki Kaisha, Tokyo, Japan

[21] Appl. No.: 516,983

[22] Filed: Apr. 30, 1990

[30] Foreign Application Priority Data

May 1, 1989 [JP] Japan ..... 1-112525
Jun. 29, 1989 [JP] Japan ..... 1-168165

[51] Int. Cl.[5] ..... G08B 29/00

[52] U.S. Cl. ..... 340/506; 340/509; 340/505; 340/518; 340/825.06

[58] Field of Search ..... 340/506, 514, 511, 509, 340/588, 589, 825.06, 505, 518

[56] References Cited

U.S. PATENT DOCUMENTS 4,529,970 7/1985 Wynne ..... 340/509
4,622,541 11/1986 Stockdale ..... 340/506
4,785,284 11/1988 Kimura ..... 340/506
4,973,943 11/1990 Arima ..... 340/506

*Primary Examiner*—Donnie L. Crosland
*Attorney, Agent, or Firm*—Wenderoth, Lind & Ponack

[57] ABSTRACT

A fire alarm system includes a receiver unit such as a fire control panel or a repeater having zone lines connected thereto, with various types of fire detectors being connected to the zone line. Supervising power is normally supplied to the zone lines. When the receiver unit receives a fire signal via a zone line from a fire detector, the receiver unit decides from what type of detector the fire signal was transmitted. Types of fire detectors include, for example, a type having as switching means only a mechanical contact for causing said zone line to be in a short-circuited condition, a type having as switching means a switching circuit with a self-holding function, or a type having a response lamp. In response to the receipt of the fire signal, either no power, or suitably reduced power or reduced constant current for the zone line to which the operated detector transmitting the fire signal is connected is supplied, depending on the type of detector that has operated, to thereby allow a reduction in power consumption.

16 Claims, 3 Drawing Sheets

FIRE ALARM SYSTEM

BACKGROUND OF THE INVENTION

1. Field of the Invention

The present invention relates to a fire alarm system in which one or a plurality of zone lines having a plurality of fire detectors connected thereto are connected to a receiver unit, such as a fire control panel or a repeater(s) connected to the fire control panel, via a signal line, the receiver unit receiving fire signals sent from the fire detectors.

2. Description of the Prior Art

It is known in the art of fire alarm systems that zone lines constituted of a pair of power supply/signal lines, etc. are connected to a fire control panel or to a repeater(s) connected to the fire alarm panel, and extend therefrom over zones, these zone lines having a plurality of fire detectors connected thereto.

Various types of fire detectors, such as a fixed temperature detector in which a mechanical contact is closed by the contrarotation of a bimetal, heat detector for detecting an increased heat rate in which a mechanical contact is closed by the expansion of a diaphragm forming an air chamber, and an ionization type, a photoelectric type or any other type smoke detector having semiconductor components such as an FET, amplifier circuit, etc., and having a switching circuit that initiates a self hold in response to the operation thereof, etc., are connected to the zone lines according to their setting positions. Each zone line includes various types of fire detectors as described above connected thereto. Some of the detectors described above may have response lamps that light in response to the detection of a fire indicating that the detector is operating, while the remaining detectors may not have such lamps.

On the other hand, a supervising power source in the fire control panel or the repeater is connected to the fire detectors via each zone line. When the fire control panel or the repeater receives a fire signal via a zone line from a fire detector which has operated in response to detecting a fire, it supplies any of the operated fire detectors via that zone line with current required to light the response lamp of the operated fire detector or required to cause the operation of the fire detector to be self-held.

As there are many types of detectors connected to one zone line as noted above, the fire control panel or the repeater evenly supplies those fire detectors with current from the supervising power source as well as current for the response lamp and for self-holding. Accordingly, even if fire detectors having, for example, only a mechanical contact closed by a bimetal, are connected to the zone line, the fire control panel or the repeater still supplies that zone line with current from the supervising power source and the lamp and self-holding current.

In the prior art, current of tens of milliamperes per detector is required to light a response lamp in a fire detector that is actuated or operated. If a plurality of detectors are operated together, a problem arises in that the large total current consumed by their response lamps requires a correspondingly larger capacity for an emergency power source such as a battery.

When a fixed temperature detector having only a mechanical contact but no response lamp or self-holding circuit is operated, a current flows through the closed mechanical contact of the fixed temperature detector in question to the zone line in order to transmit the fire signal to the receiver unit such as a fire control panel or a repeater. After the operation, the mechanical contact maintains its closed condition and the current continues to flow through the mechanical contact. However, no current flow through the mechanical contact and the zone line to the receiver unit is needed because it is sufficient to transmit only one fire signal to the receiver unit to inform the receiver unit of the fire situation, and accordingly, current subsequently flowing through the mechanical contact is ineffective. Moreover, because the resistance of the mechanical contact closed is small, the current flowing through the overall circuit from that mechanical contact to the receiver unit such as a fire control panel is decided only by way of a line resistance of the zone line and thus the ineffective current value is very large.

In order to prevent this ineffective current flow, it may be thought to provide two individual circuits or lines for each zone, one circuit for connecting fire detectors of a type having only a mechanical contact and the other circuit for connecting the other types of fire detectors which require the supply of current after operation. However, providing two circuits or lines in a single fire monitoring area increases the number of zone lines sharply and causes the system to be complex and expensive, whereby additional problems arise in that fire detectors might possibly be installed in the wrong circuit when alteration of an installed system is required.

SUMMARY OF THE INVENTION

It is an object of the present invention to reduce the current consumed by fire detectors to be operated.

It is another object of the present invention to reduce the current consumption by interrupting the current supply to a fire detector that only has a mechanical contact but no confirmation lamp or self-holding circuit, when that fire detector is operated.

It is a further object of the present invention to reduce the current consumption by supplying only current required for self-holding, to a fire detector that has a switching circuit with the self-holding function, when that fire detector is operated.

It is still another object of the present invention to reduce the current consumed by a response lamp when a fire detector having a response lamp is operated.

In accordance with the present invention, a receiver unit such as a fire control panel or a repeater to which zone lines are connected is provided with decision means for deciding whether or not a fire detector having only a mechanical contact as switching means is operated, whereby upon receipt of a fire signal from such fire detector, the power supply to the zone line to which that fire detector is connected is interrupted by the decision means.

Also, in accordance with the present invention, the receiver unit is provided with power control means responsive to the receipt of a fire signal from a fire detector for supplying the zone line to which that detector is connected with only that current required for holding a fire detector having a switching circuit with a self-holding function.

Additionally, in accordance with the present invention, the receiver unit is provided with decision means responsive to the receipt of a fire signal for deciding whether the fire signal has been transmitted from a fire detector having only a mechanical contact or from a fire detector having a switching circuit with a self-holding function, and is further provided with power control means responsive to the receipt of a fire signal from an operated fire detector having only a mechanical contact to interrupt the connection of the power source to the zone line to which that operated fire detector is connected, and responsive to the receipt of a fire signal from an operated fire detector having a switching circuit with a self-holding function to supply the zone line to which that operated fire detector is connected with only that current required for holding that fire detector.

Further, in accordance with the present invention, the power control means is provided with means for intermittently supplying the zone line with light emission current required for a response lamp to emit light while only that current required for holding a fire detector is supplied for the zone line.

Also, in accordance with the present invention, the power control means is provided with means for alternately supplying a large current for strong light emission of the response lamp of the fire detector and an intermediate current for weak light emission thereof.

BRIEF DESCRIPTION OF THE DRAWINGS

An embodiment of the invention will now be described by way of example and with reference to the accompanying drawings, in which.

DESCRIPTION OF THE PREFERRED EMBODIMENT

Figure 1:
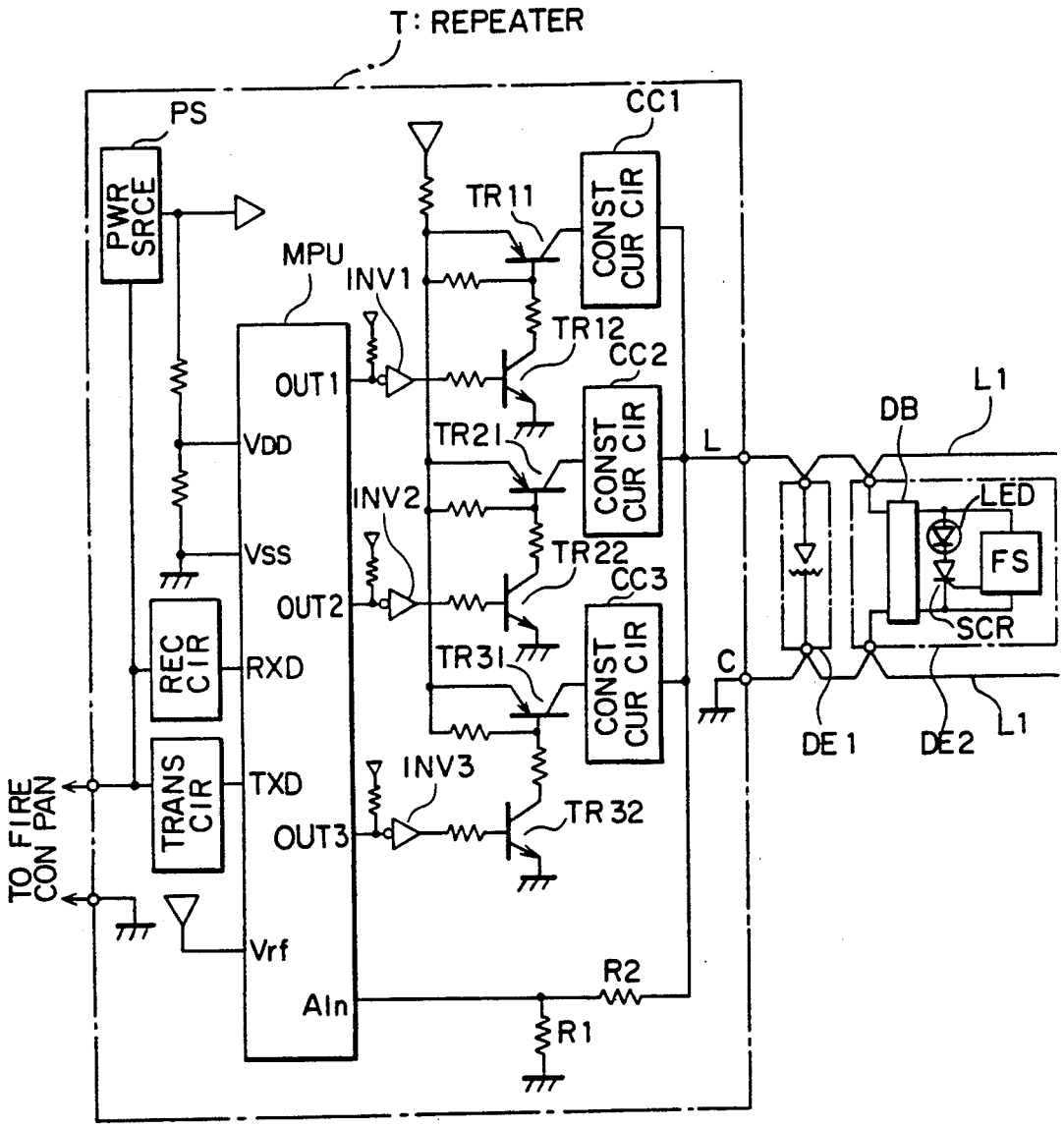
FIG. 1 is a block diagram of the fire alarm system in accordance with one embodiment of the present invention.

FIG. 1 is a circuit diagram showing one embodiment of a fire alarm system in accordance with the present invention.

In the embodiment of FIG. 1, the fire alarm system has a repeater T as a receiver unit by way of example to which a heat detector DE1 and a photoelectric type smoke detector DE2 are connected by a zone line L1.

The heat detector DE1 is an example of a fire detector which only has a mechanical contact and does not have an operation indicating lamp or a response lamp and self-holding circuit. The mechanical contact comprises a contact pressed by a diaphragm provided in an air chamber or by the contrarotation of a bimetal.

The photoelectric type smoke detector DE2 is an example of a fire detector which has a semiconductor circuit and a response lamp. The fire detector DE2 comprises a non-polarized diode bridge DB, an operation indicating lamp LED, a silicon controlled rectifier SCR as one example of a switching circuit for fire signal transmission having a self-holding function, and a smoke detection portion FS including a light scattering type smoke detecting portion, a fire decision circuit, etc.

The repeater T is connected to a fire control panel which is not shown, by way of a pair of power supply/signal lines, and comprises a power source PS, a receiving circuit and a transmitting circuit, a microcomputer MPU, inverters INV1–INV3, transistors TR11–TR32, constant current circuits CC1–CC3, and fire signal detection resistors R1, R2.

The power source PS is a constant voltage circuit for converting the power source supplied via the power supply/signal lines from the fire control panel, into a voltage required for internal circuits as well as a voltage required for the fire detectors.

Figure 2:
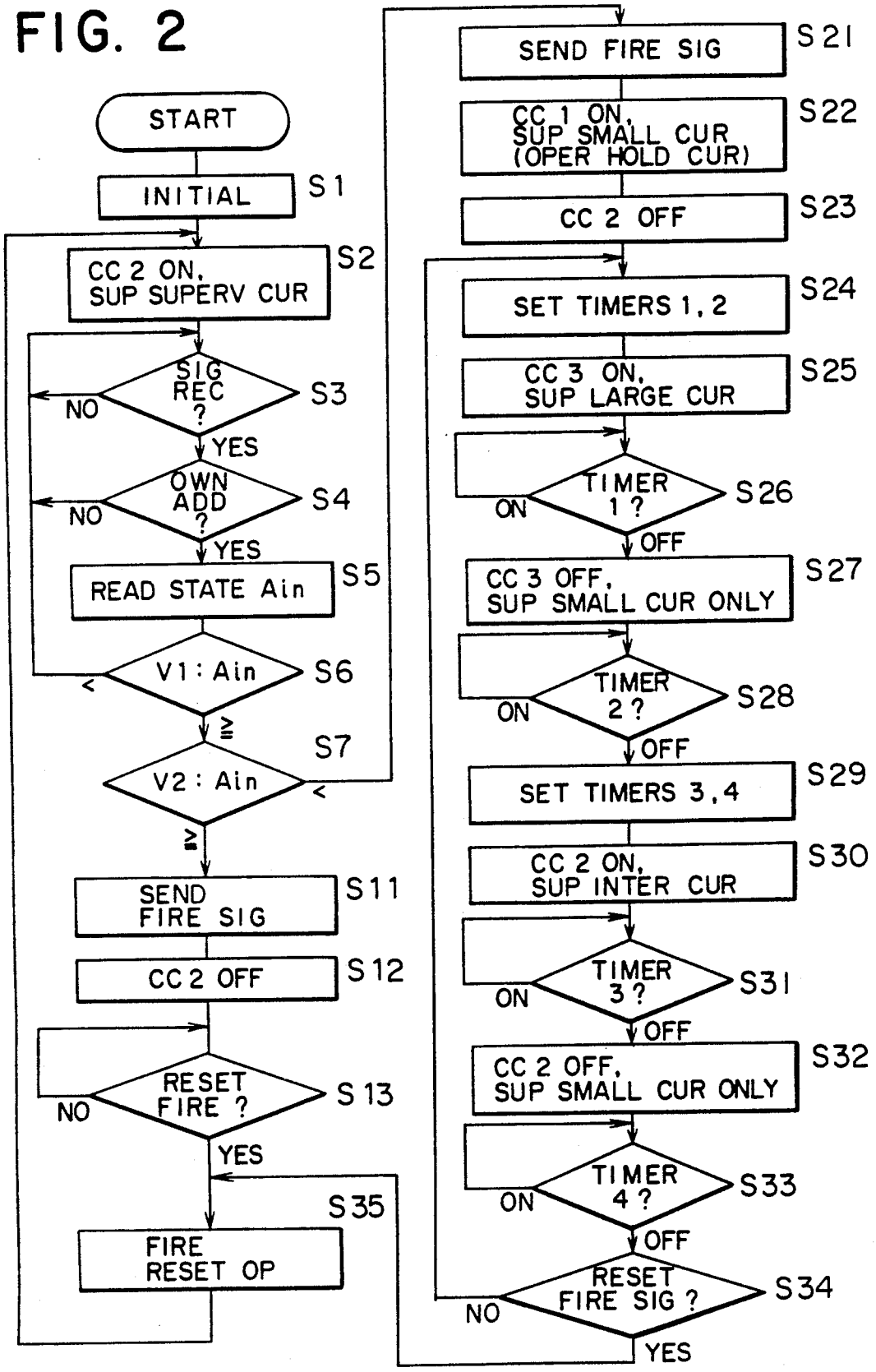
FIG. 2 is a flowchart for describing the operation of the embodiment of FIG. 1.

The microcomputer MPU carries out the program shown in the flowchart in FIG. 2, and comprises output ports OUT1–OUT3 for control, an input port Ain for an A/D (analogue/digital) converter (not shown) incorporated therein, an input port Vrf for a reference voltage of the A/D converter, and timer 1–timer 4 (not shown) incorporated therein.

The constant current circuit CC1 supplies the SCR of a fire detector such as DE2 with current for holding the operation of the SCR when the SCR is in the on-state. The constant current circuit CC2 normally supplies detectors DE1, DE2, . . . with a supervising current, and supplies the response lamp LED of a detector such as DE2 with an intermediate current when the SCR of a detector such as DE2 is in the on-state. The constant current circuit CC3 supplies the response lamp LED of a detector such as DE2 with a large current when the SCR of a detector such as DE2 is in the on-state.

Now, the operation of the above-said fire alarm system shown in FIG. 1 will be explained hereinbelow.

FIG. 2 is a flowchart explaining the operation of the embodiment shown in FIG. 1.

First, initialization (S1) is performed. Then the microcomputer MPU normally sets the output of its output port OUT2 to L or low to turn on the transistors TR21 and TR22, whereby the supervising power source of 24 volts is supplied to the detectors DE1, DE2 via the constant current circuit CC2 the detectors DE1, DE2 via the constant current circuit CC2 (S2).

If the repeater T receives a signal from the fire control panel (S3) and decides that the received signal is a calling signal for that repeater T itself, namely that the address of the repeater T is transmitted from the fire control panel (S4), then the state of the zone line L1 is read. Namely, the microcomputer MPU reads the voltage on the terminal Ain as the state of the zone line L1 (S5), which voltage is divided by voltage divider resistors R1 and R2.

Then the voltage on the terminal Ain is digitized by the A/D converter (not shown) incorporated in the microcomputer to be compared with a first reference voltage V1 and a second reference voltage V2. For example, the first reference voltage is set to 10 volts and the second reference voltage to 2 volts. The various kinds of voltages described herein may be arranged in descending order, as follows:

(1) the voltage of the zone line L1 under monitoring or supervising;
(2) the first reference voltage V1 (10 volts);
(3) the voltage of the zone line L1 under operation of the photoelectric type smoke fire detector DE2;
(4) the second reference voltage V2 (2 volts); and
(5) the voltage of the zone line L1 under operation of the heat fire detector DE1.

If the voltage on the terminal Ain is equal to or less than the first reference voltage V1 (S6) and is more than the second reference voltage V2 (S7), this means that the photoelectric type smoke detector DE2 has been actuated or operated and accordingly the repeater T sends a fire signal to the fire control panel (S21).

At this time, the microcomputer MPU delivers a low level L at the output port OUT1 to turn on the transistors TR11 and TR12 and to actuate the constant current circuit CC1, so as to supply the zone line L1 with the operation holding current for holding the operation of the SCR of the detector DE2 (at this time, the voltage between terminals C and L is approximately 3 volts) (S22). The microcomputer further delivers a high level H at the output port OUT2 to halt the actuation of the constant current circuit CC2, so as to stop the supply of the supervising current to the detectors DE1, DE2, . . . (S23). In such a manner, only the current (for example, 5 mA) required to self-hold the SCR is supplied from the constant current circuit CC1 to the detector DE2.

Figure 3:
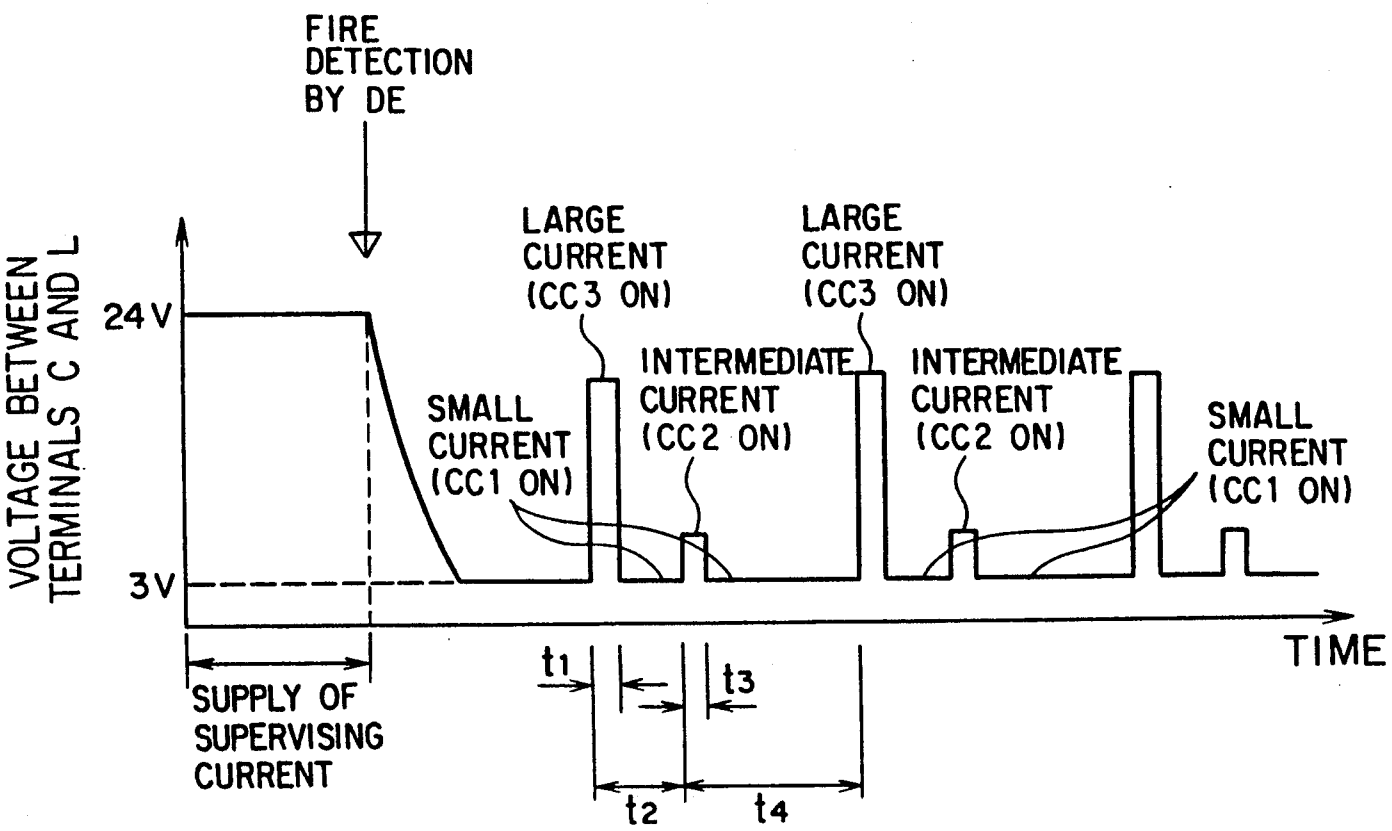
FIG. 3 is a timing chart showing one example of a CL voltage in the operation of the above-said embodiment.

Next, the timer 1 and the timer 2 provided in the microcomputer MPU are set (S24) to deliver a low level L at the output port OUT3 to turn on the transisitors TR31 and TR32 and thereby to actuate the constant current circuit CC3, whereby the large current is supplied for the response lamp LED of the detector DE2 (S25). Then, in response to the turning off of the timer 1 (S26), a high level H is delivered at the output port OUT3, whereby the supply of the above-said large current is stopped (S27) and only the small current is supplied to the SCR of the detector DE2. This is shown in FIG. 3 wherein the large current is supplied to the response lamp LED only for a time period t1 during which the timer 1 is set.

Thereafter, in response to the turning off of the timer 2 (S28), the timers 3 and 4 are set (S29) to deliver the low level L at the output port OUT2 to actuate the constant current circuit CC2 whereby the intermediate current is supplied to the confirmation lamp LED. Then, in response to the turning on of the timer 3, the actuation of the constant current circuit CC2 is stopped whereby the supply of the intermediate current to the response lamp LED is stopped and only the small current is supplied to the SCR (S30, S31, S32). This is shown in FIG. 3 wherein the intermediate current is supplied to the response lamp LED only for the time period t3 during which the timer 3 is set.

Thereafter, in response to the turning off of the timer 4 (S33), if there is a fire resetting signal (S34), the operation proceeds to the fire resetting operation (S35), then returns to S2. If there is not a fire resetting signal (S34), the operation returns to S24. This fire resetting operation (S35) is performed in such a manner, for example, to deliver high levels H at the output ports OUT1, OUT2, OUT3 for a predetermined time period such as 5 seconds.

On the other hand, if the voltage Ain of the zone line L1 is less than the second reference voltage V2 (S7), which means that the heat detector DE1 is actuated or operated, the repeater T sends a fire signal to the fire control panel (S11) and the microcomputer MPU delivers the high level H at the output port OUT2 to thereby halt the actuation of the constant current circuit CC2 (S12). This interrupts the flow of current through the zone line L1, which prevents large current from being inefficiently consumed as in the prior art.

FIG. 3 is a timing-chart showing the waveform of the voltage between terminals C and L when in the above-described embodiment the detector DE2 is actuated or operated.

As shown in FIG. 3, before the detector DE2 detects a fire, a voltage of 24 volts is applied between terminals C and L to thereby supply the detector DE2 with supervising current. After the detector DE2 detects a fire, the voltage between terminals C and L is lowered to 3 volts, due to which the operation holding current (small current) is supplied for the SCR. While the operation holding current is supplied for the SCR, the large current and the intermediate current are intermittently supplied for the response lamp LED.

Accordingly, as the large current and intermediate current intermittently flow to the response lamp LED after the detector DE2 detects a fire, this ensures that the response lamp LED will be lighted to indicate the operation of this detector. On the other hand, in the period where the large current and the intermediate current do not flow to the response lamp LED, only the operation holding current flows to the SCR, thus reducing the amount of electric power supplied from the repeater T to the detector DE2. Reducing the electric power supplied to the operated detector prevents the line voltage of the transmission line between the repeater T and the fire control panel from being lowered by the operation of that detector.

In the above-described embodiment, although in order to obtain the supervising current sent to the detectors DE1, DE2, . . . , the voltage between terminals C and L is set to 24 volts, it is a matter of course that other voltages may be set. The same also applies to the voltage between terminals C and L for supplying the operation holding current of the SCR, which voltage is set to 3 volts in the above-described embodiment.

It is also possible to alternately have the large current and the intermediate current flow through the lamp, without the small current, to give an appearance of almost continuous lighting of the response lamp LED by utilizing the afterimage effect in human vision, due to the alternate flow of the large current and the intermediate current.

Further, it may also be possible to omit the supply of the intermediate current from the constant current circuit CC2 for light emitting or lighting the response lamp LED, thereby supplying only the current from the constant current circuit CC3. Namely, the repeater T may intermittently supply the detector DE with either the large current alone or the alternate current including the large current and the intermediate current.

Moreover, it is possible to utilize a polling signal from the fire control panel as a synchronization signal for lighting the response lamp LED.

It is also possible to utilize, as a fire detector having a switching circuit with a self-holding function, a smoke detector such as an ionization type or a light obscuration type smoke detector, and a heat detector using a thermister, a diode or any other device as a heat sensitive element, etc.

Further, it is possible to constitute the switching circuit having a self-holding function with a plurality of transistors.

In the above-described embodiment, although the repeater T is shown as a receiver unit, it is also possible to use as a receiver unit a fire control panel to which the zone lines are directly connected.

In accordance with the present invention, there is the effect of preventing the flow of an ineffective current to the zone line to which the operated fire detector is connected, when a fire detector having only a mechanical contact, but not a response lamp and a self-holding circuit, is operated.

Also, in accordance with the present invention, there is the effect of reducing the consumption of current for the zone line to which the operated fire detector is connected, when a fire detector having a switching circuit with a self-holding function is operated.

Further, in accordance with the present invention, there is the effect of reducing the consumption of current for emitting the light of the response lamp when a fire detector having a response lamp is operated.

While the embodiment of the present invention, as herein disclosed, constitutes a preferred form, it is to be understood that other forms might also be adopted.

What is claimed is:

1. A fire alarm system in which a receiver unit such as a fire control panel or a repeater connected to the fire control panel via a signal line has one or plural zone lines connected thereto, said one or plural zone lines having fire detectors connected thereto, said receiver unit receiving a fire signal sent from said fire detectors, said receiver unit comprising:

decision means, responsive to a fire signal received via a zone line from a fire detector, for determining based on the received fire signal whether the fire detector is of a type having only a mechanical contact which functions as a switching means for causing said zone line to be placed in a short-circuited condition when the mechanical contact is closed;

a power control device including supervising power source supply means for supplying current from a supervising power source to said zone lines for said fire detectors and interrupting means for normally connecting said supervising power source supply means to said zone lines for said fire detectors and for interrupting a power supply by said supervising power source supply means to a zone line when said decision means determines that a fire signal received via the zone line is received from a fire detector of the type having only a mechanical contact which functions as the switching means.

2. A fire alarm system as set forth in claim 1, wherein said power control device further includes:

holding current supply means responsive to the operation of a fire detector having as switching means a switching circuit with a self-holding function for supplying the zone line to which the operated fire detector is connected with only an operation holding current required to hold the operation of the operated fire detector; and switching means for normally connecting said supervising power source supply means to said zone lines, and for switching said holding current supply means to the zone line which initiated a fire signal when said decision means determines that the received fire signal is not from a fire detector of the type having only a mechanical contact as the switching means.

3. A fire alarm system as set forth in claims 1 or 2, wherein said decision means decides on the basis of the received fire signal whether the fire signal is received from fire detectors having only the mechanical contact or from fire detectors having a switching circuit with a self-holding function.

4. A fire alarm system as set forth in claims 1 or 2 wherein said decision means comprises voltage measuring means for measuring the voltage of the zone lines, and detecting means for detecting when said voltage of the zone lines reaches a predetermined voltage corresponding to an operation voltage of a fire detector.

5. A fire alarm system as set forth in claims 1 or 2, wherein said fire detector having only a mechanical contact has a bimetal or an air chamber, so that said mechanical contact is closed by the contra-rotation of said bimetal and/or by the expansion of said air chamber.

6. A fire alarm system as set forth in claim 3, wherein said decision means comprises voltage measuring means for measuring the voltage of the zone lines, and detecting means for detecting when said voltage of the zone lines reaches a predetermined voltage corresponding to an operation voltage of a fire detector.

7. A fire alarm system as set forth in claim 6, wherein said fire detector having only a mechanical contact has a bimetal or an air chamber, so that said mechanical contact is closed by the contra-rotation of said bimetal and/or by the expansion of said air chamber.

8. A fire alarm system as set forth in claim 3, wherein said fire detector having only a mechanical contact has a bimetal or an air chamber, so that said mechanical contact is closed by the contra-rotation of said bimetal and/or by the expansion of said air chamber.

9. A fire alarm system as set forth in claim 4, wherein said fire detector having only a mechanical contact has a bimetal or an air chamber, so that said mechanical contact is closed by the contra-rotation of said bimetal and/or by the expansion of said air chamber.

10. A fire alarm system as set forth in claim 3, wherein said fire detector having a switching circuit with a self-holding function is a smoke detector of a photoelectric type, an ionization type or a light obscuration type, or a heat detector provided therein with a semiconductor circuit.

11. A fire alarm system in which a receiver unit such as a fire control panel or a repeater connected to the fire control panel via a signal line has one or plural zone lines connected thereto, said one or plural zone lines having fire detectors connected thereto, said receiver unit having a power control device and receiving a fire signal sent from said fire detectors, said power control device comprising:

supervising power source supply means for supplying current from a supervising power source to said zone lines for said fire detectors;

holding current supply means responsive to the operation of a fire detector having as a switching means a switching circuit with a self-holding function for supplying a zone line to which the operated fire detector is connected with only an operation holding current required to hold the operation of the operated fire detector; and switching means for normally connecting said supervising power source supply means to said zone lines, and responsive to the reception of a fire signal from a zone line for switching from the connection of said supervising power source supply means to the zone line from which the fire signal is received to a connection of said holding current supply means to the zone line from which the fire signal is received.

12. A fire alarm system as set forth in claims 2 or 11, wherein said power control means comprises light emitting current supply means responsive to the connection of said holding current supply means to a zone line for intermittently supplying that zone line with a light emitting current for causing a response lamp provided in the fire detector of that zone line to emit light.

13. A fire alarm system as set forth in claim 12, wherein said fire detector having a switching circuit with a self-holding function is a smoke detector of a photoelectric type, an ionization type or a light obscuration type, or a heat detector provided therein with a semiconductor circuit.

14. A fire alarm system as set forth in claim 12, wherein said emitting light current supply means intermittently supplies a large current and an intermediate current for alternate light emission.

15. A fire alarm system as set forth in claim 14, wherein said fire detector having a switching circuit with a self-holding function is a smoke detector of a photoelectric type, an ionization type or a light obscuration type, or a heat detector provided therein with a semiconductor circuit.

16. A fire alarm system as set forth in claims 2 or 11, wherein said fire detector having a switching circuit with a self-holding function is a smoke detector of a photoelectric type, an ionization type or a light obscuration type, or a heat detector provided therein with a semiconductor circuit.

* * * * *